United States Patent [19]

Martinez

[11] Patent Number: 4,882,570

[45] Date of Patent: Nov. 21, 1989

[54] VEHICLE AND DISTRESS INDICATOR THEREFOR

[75] Inventor: Antonio Martinez, Bronx, N.Y.

[73] Assignee: Argo Instruments Inc., Winchester, Va.

[21] Appl. No.: 198,460

[22] Filed: May 25, 1988

[51] Int. Cl.[4] ..... G08B 5/38

[52] U.S. Cl. ..... 340/574; 340/472; 340/691

[58] Field of Search ..... 340/574, 691, 78, 89, 340/81 R, 472, 471

[56] References Cited

U.S. PATENT DOCUMENTS

| | | | |
|---|---|---|---|
| 2,807,795 | 9/1957 | Haber | 340/81 R |
| 3,703,703 | 11/1972 | Payne | 340/691 |
| 4,550,304 | 10/1985 | Saitta | 340/78 |
| 4,768,027 | 8/1988 | Benjamin et al. | 340/691 |

*Primary Examiner*—Glen R. Swann, III

*Attorney, Agent, or Firm*—Stanger, Michaelson, Reynolds, Spivak & Tobia

[57] ABSTRACT

A foot switch operated by a driver of a vehicle such as a taxicab actuates a circuit which disables the indicating lamps in the taxi's roof light and energizes distress signaling lamps in the roof light so that it flashes on and off. The flashing roof light calls attention to the cab and informs others that the taxi is in a distress situation.

8 Claims, 5 Drawing Sheets

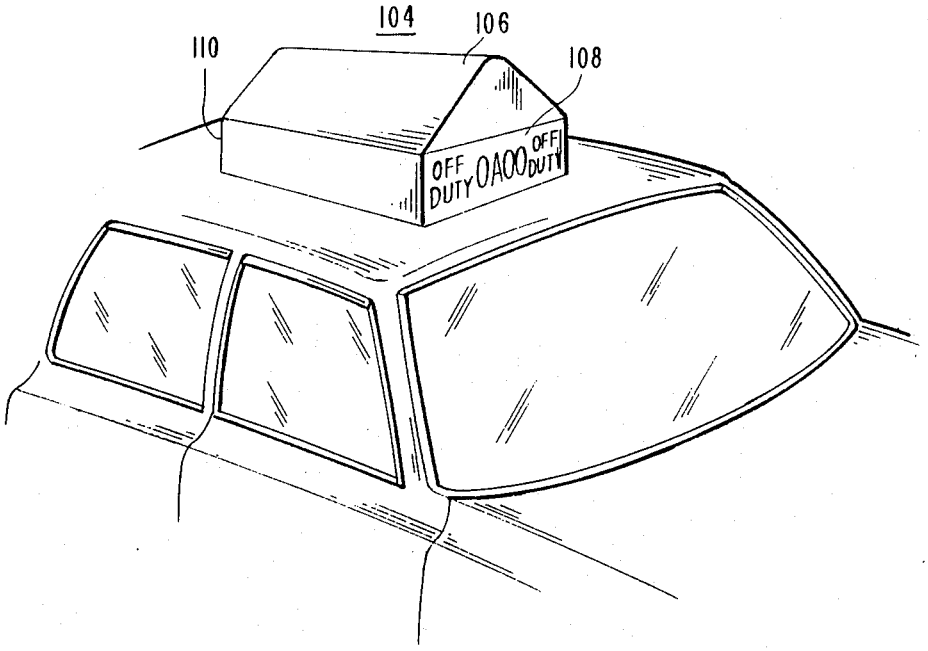
FIG. 4
FIG. 5
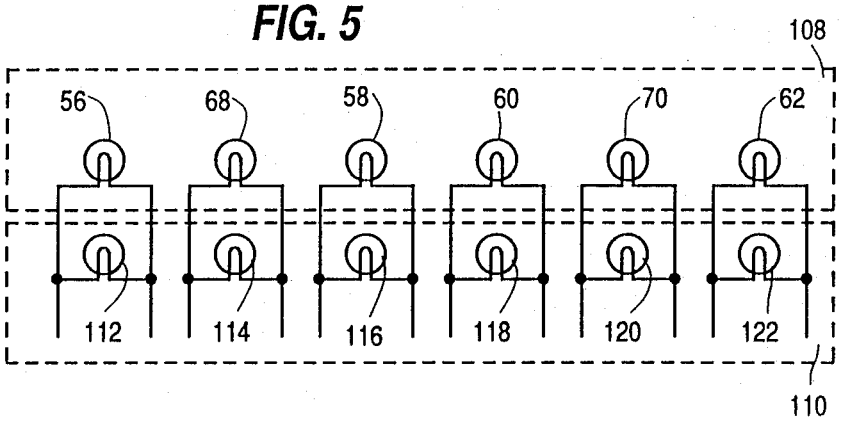

VEHICLE AND DISTRESS INDICATOR THEREFOR

BACKGROUND OF THE INVENTION

This invention relates to vehicles such as taxicabs and particularly to distress signaling apparatuses that co-act with taxi roof lights to inform the public of the taxi's availability for hire.

Recently, many taxicab drivers and drivers of other commercial vehicles have become the victims of assaults, robberies, and other crimes. Often the perpetrators of these acts enter the cabs as passengers and sit behind the driver where the latter has little opportunity of defending him or herself. Municipal authorities have made attempts to protect such vulnerable taxi drivers. For example, some cities mandate that a rigid plastic shield divide the vehicle's passenger compartment into driver and passenger sections so as to protect the driver from direct attack by persons in the rear seat. Small openings in the shield allow the passenger to communicate with the driver and to pay the fare. While this affords the driver some protection, the latter is still subject to assault with a weapon and from other directions. Also, the shield alone is ineffective for alerting others of the driver's predicament. Moreover, the driver may need other types of help, for example when a passenger becomes ill in the cab.

Some attempts have been made to furnish taxi distress signals by adding visible signaling devices to the vehicle bodies. For example, U.S. Pat. No. 4,550,304 to Saitta discloses an alarm apparatus mounted on top of the taxi roof light. The roof light is a conventional device that notifies the public whether the taxi is available for hire, is in use, or off duty. The Saitta apparatus sits on top of the roof light and projects light signals in four angular directions.

Such a device is unnecessarily complex and expensive. It also alerts a prospective perpetrator that the driver may use a distress signal and may cause the potential criminal to order the driver not to use his warning device. Other devices have similar disadvantages.

OBJECTS AND SUMMARY OF THE INVENTION

An object of the invention is to furnish a vehicle with a reliable means for permitting a driver to communicate a distress situation to others outside the vehicle.

Another object is to provide such a system within the framework of existing vehicles.

Yet another object of the invention is to offer such a system which is innocuous, and preferably substantially inaudible to a perpetrator within the vehicle.

According to a feature of the invention, the vehicle includes a switch that disables the ordinary roof lights of a taxicab and simultaneously flashes lights to signal a distress condition.

According to another feature of the invention, the lights being flashed are mounted within a taxi roof light housing.

According to yet another feature of the invention, the flashing lights are of a color different from the ordinary color of the lights in the roof light.

These and other features of the invention are pointed out in the claims. Other objects and advantages of the invention will be evident from the following detailed description when read in light of the accompanying drawings.

BRIEF DESCRIPTION OF THE DRAWINGS

In the drawings:

FIG. 4 is a perspective view of another vehicle embodying features of the invention.

FIG. 5 is a schematic diagram of the lamps in FIG. 4.

DETAILED DESCRIPTION OF PREFERRED EMBODIMENTS

Figure 1:
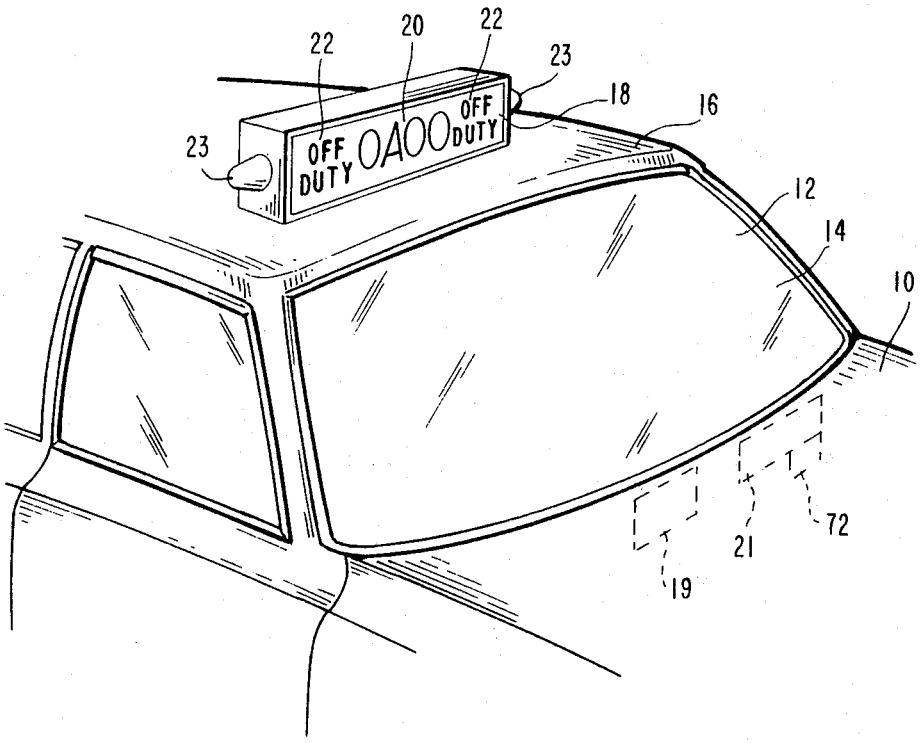
FIG. 1 is a perspective view of a vehicle embodying features of the invention.

In FIG. 1 a taxi 10, forming an interior compartment 12 behind a windshield 14 and under a roof 16, carries a roof light 18 on the roof. The light 18 serves to indicate to prospective passengers the availability of the taxi for hire. For example, the drier operates a taximeter 19 containing several meter switches to illuminate the "medallion" number 20 of the taxi when the vehicle is seeking passengers and turns off the medallion number when the taxi is occupied by a fare. To indicate that the vehicle is without passengers but that the taxi is nevertheless unavailable, the driver presses a switch on a dashboard 21 to illuminate the "off-duty" lights 22. Right and left turn indicating lights 23 project from the ends of the housing.

Figure 2:
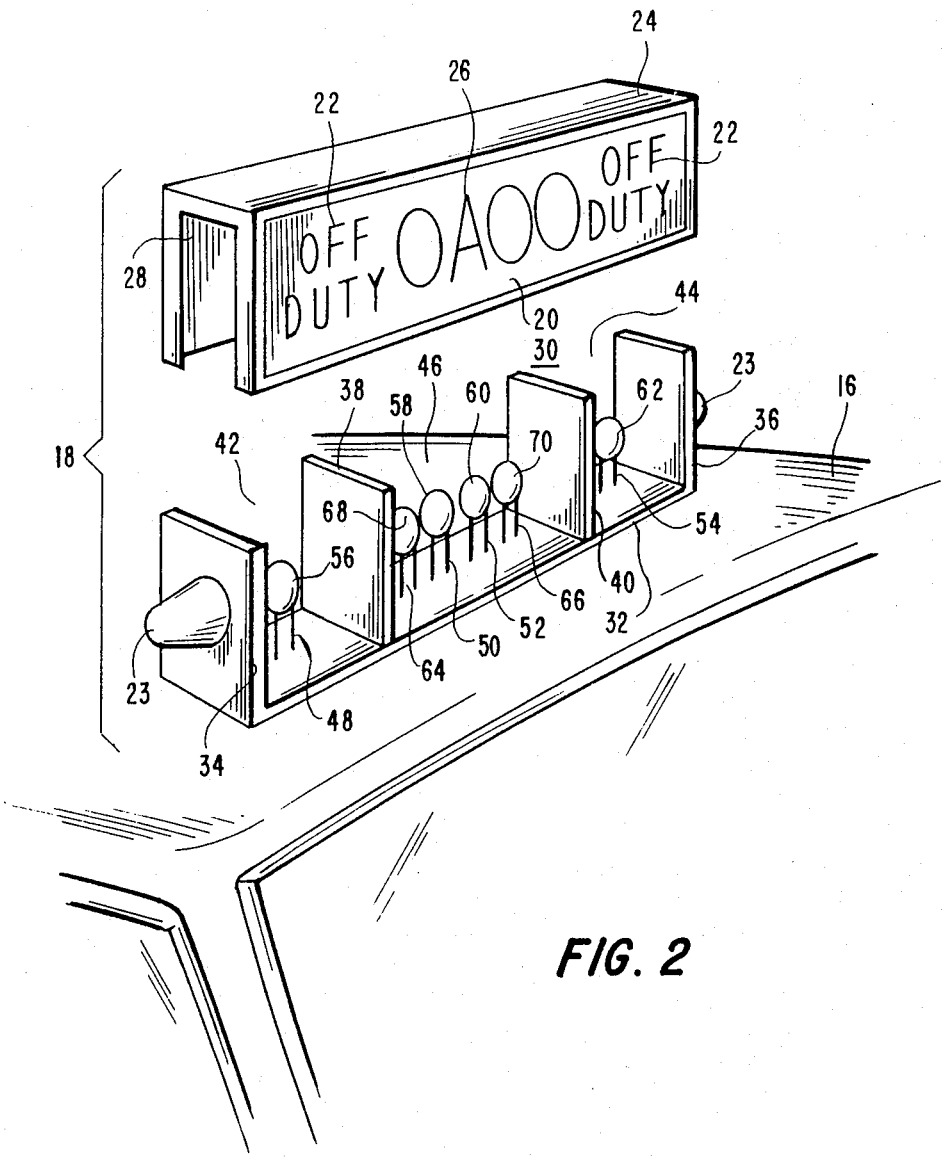
FIG. 2 is an exploded perspective view of the roof light located on the vehicle in FIG. 1 and embodying features of the invention.

Details of the roof light 18 appear in FIG. 2. As shown, the roof light 18 includes an inverted U-shaped cover 24 having front and rear translucent panels 26 and 28 both of which carry the medallion number 20 and the "off-duty" displays 22. The cover 24 fits over the base 30 of the housing 18 secured to the roof 16. In the base 30, a base plate 32 fixed to the roof 16 supports two upstanding outer walls 34 and 36 and two opaque interior walls 38 and 40 which separate the housing into two outside chambers 42 and 44 behind the "off-duty" displays on the panels 26 and 28 and an central chamber 46 behind the medallion number 20.

Bayonet or screw sockets 48, 50, 52, and 54 hold and energize respective white lamp bulbs 56, 58, 60, and 62. When lit, the white bulbs 56 and 62 illuminate the end chambers 42 and 44 and the adjacent "off-duty" displays 22 on the panels 26 and 28, and the white bulbs 58 and 60 illuminate the central chamber 46 and the adjacent medallion number 20 on the panels 26 and 28. The opaque interior walls 38 and 40 block the light from the lamps 56 and 62 so they only illuminate the "off-duty" displays 22 and not the medallion numbers 26, and so the lamps 58 and 60 light up only the medallion numbers without the "off-duty" displays. Bayonet or screw sockets 64 and 66 energize two amber lamps 68 and 70 astride lamps 58 and 60. When lit the amber lamps 68 and 70 illuminate only the central chamber 46 and the medallion number 20.

Figure 3:
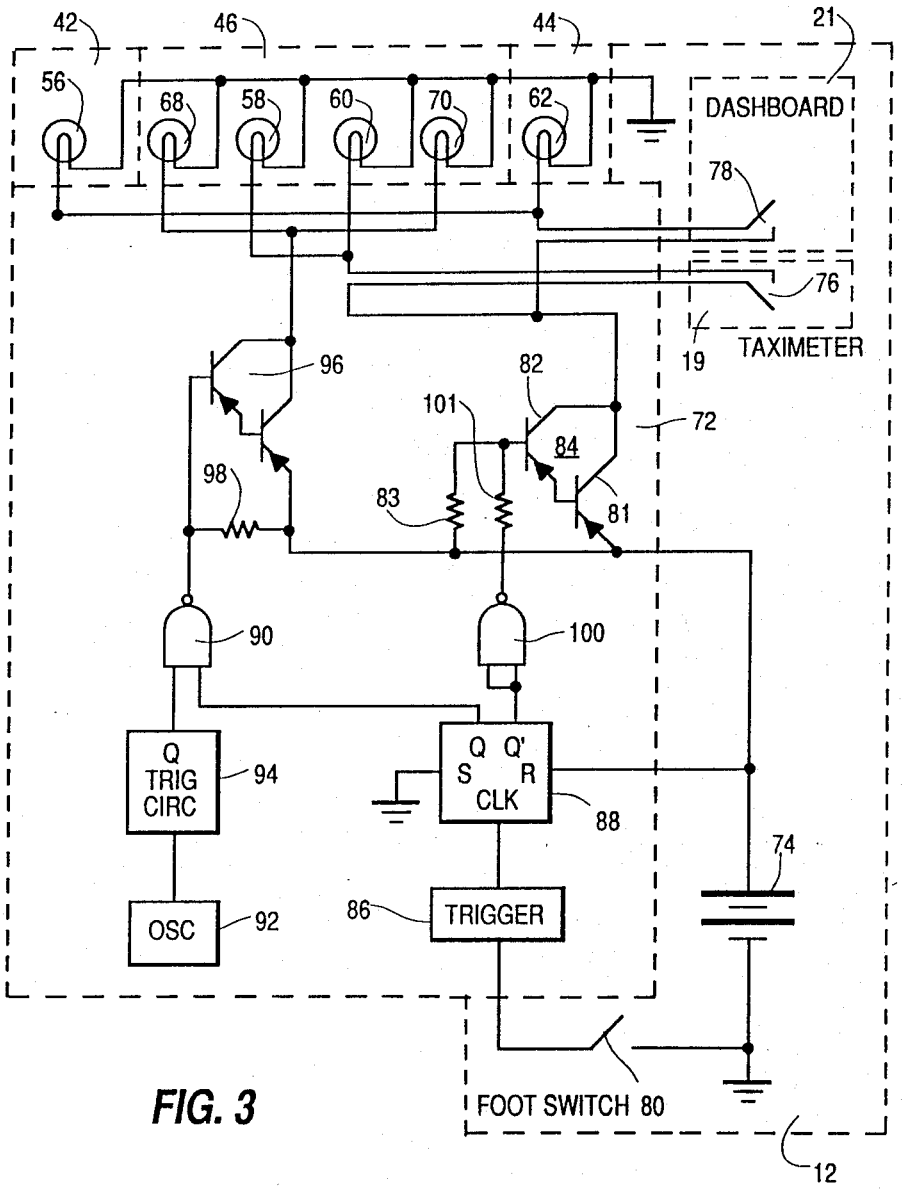
FIG. 3 is a schematic diagram of the electrical system of FIGS. 1 and 2 and embodying features of the invention.

A semiconductor circuit 72 on a chip or circuit board mounted under or behind the dashboard 21 connects the sockets 48, 50, 52, 54, 64, and 66 to the vehicle's battery 74 to a meter switch 76, to an off-duty switch 78 and to a toggling foot switch 80 within the compartment 12 as shown in the circuit diagram of FIG. 3. The driver operates the meter switch 76 from the taximeter 19 mounted in the compartment 12 in the conventional manner and the off-duty switch 78 on the dashboard 21. The foot switch 80 is located, out of sight of a passenger in the back seat of the vehicle, to the left of the brake pedal or, if the vehicle contains one, the clutch pedal, within easy reach of the driver's foot. The position of the foot switch 80 approximates that occupied by the "bright-light" switch in other vehicles.

In the circuit 72, a pair of PNP transistors 81 and 82 and a biasing resistor 83 form a Darlington circuit 84 to connect the switches 76 and 78 to the battery 74. Thus, when the driver closes the switch 76 to indicate that the cab is for hire the, Darlington circuit 84 completes a circuit from the battery 74, through the Darlington circuit, through the switch 76, through the lamps 58 and 60, to ground, and back to the negative pole of the battery 74. Similarly, when the driver closes the switch 78, a complete circuit runs from the battery 74, through the Darlington circuit 84, through the switch 78, through the "off-duty" lamps 56 and 62, and through ground back to the battery negative. Accordingly the driver can operate the medallion number lights and "off-duty" lights in the conventional manner when no distress condition prevails.

When the driver actuates the toggling foot switch 80 in response to a distress condition, a trigger circuit responds by applying an input to the clock terminal of a continuously reset RS flip flop 88. The output Q of the flip flop 88 then applies a positive input to open a NAND gate 90 to pulses from the other input of the NAND gate. These pulses at the other input arise from an oscillator 92 which causes a trigger 94 to apply the pulses to the left input of the NAND gate 90.

The oscillator 92 generates a frequency suitable for flashing the lights 68 and 70, such as for example 5 Hz to 1 Hz. The positive pulses at the input to the NAND gate 90 produces negative pulses at its output in response to the positive step from the output Q of the flip flop 88. These negative pulses turn on a Darlington circuit 96 which includes a biasing resistor 98 and is normally biased off. Each pulse closes a path from the positive plate of the battery 74 through the Darlington circuit 96 to the amber lamps 68 and 70 and back to ground. This makes the amber lamps 68 and 70 flash at the frequency determined by the oscillator 92.

While the positive step from the output Q turns on the NAND gate 90, the output Q', i.e., Q-bar or Q(not), of the flip flop 88 applies a negative step to the inputs of a NAND gate 100. The output of the NAND gate 100 then goes positive and, through a resistor 101, turns off the transistors 82 and 84 and hence the Darlington circuit 84. This breaks the circuit to the medallion and "off-duty" lamps 56, 58, 60, and 62 and disables them.

In operation, the transistors 81 and 82 of the Darlington circuit 84 are conductive until a distress condition requires the operator to send a distress signal. Furthermore, the distress system including the members 86 to 96 operates directly from the battery and therefore independently of the engine or ignition being on or off.

When the driver wishes to indicate an empty cab available for hire, he or she turns on the meter switch 76. This turns on the lamps 58 and 60 to illuminate the medallion numbers 20. When a fare is found, the driver turns off the switch 76 to darken the lamps 58 and 60. When the driver goes off duty, the driver turns on the switch 78 and the lamps 56 and 62 light up the "off-duty" display 22.

In the event of a distress situation requiring the assistance of others, the driver closes the foot switch 80 and the trigger 86 causes a negative step at the output Q' of the flip flop 88 to make the NAND gate 100 positive and turn off the transistors 81 and 82 of the Darlington circuit 84. This disables the lamps 56, 58, 60, and 62 whether the ignition is on or off, and whether the switches 76 or 78 are open or closed. At the same time the positive signal at the output Q of the flip flop 88 and the NAND gate 90 permits the latter to respond to positive trigger pulses arising from the oscillator 90 to produce negative pulses that render the PNP Darlington circuit 96 conductive. This flashes amber lamps 68 and 70 to send out a visible distress signal whether the ignition is on or off and whether the switches 76 or 78 are open or closed.

The driver can resume normal operation by again switching the toggling foot switch 80 to turn it off. The transistors 81 and 82 return to their on condition and the Darlington circuit 96 to its off condition. The gate 90 goes off due to a negative signal from terminal Q in the flip flop 88.

The use of solid state circuitry, particularly transistors 81, 82, and 96, in lieu of relays prevents audible clicking which might otherwise inform a perpetrator of a hazard against the driver that the driver is sending a distress signal.

Figure 6:
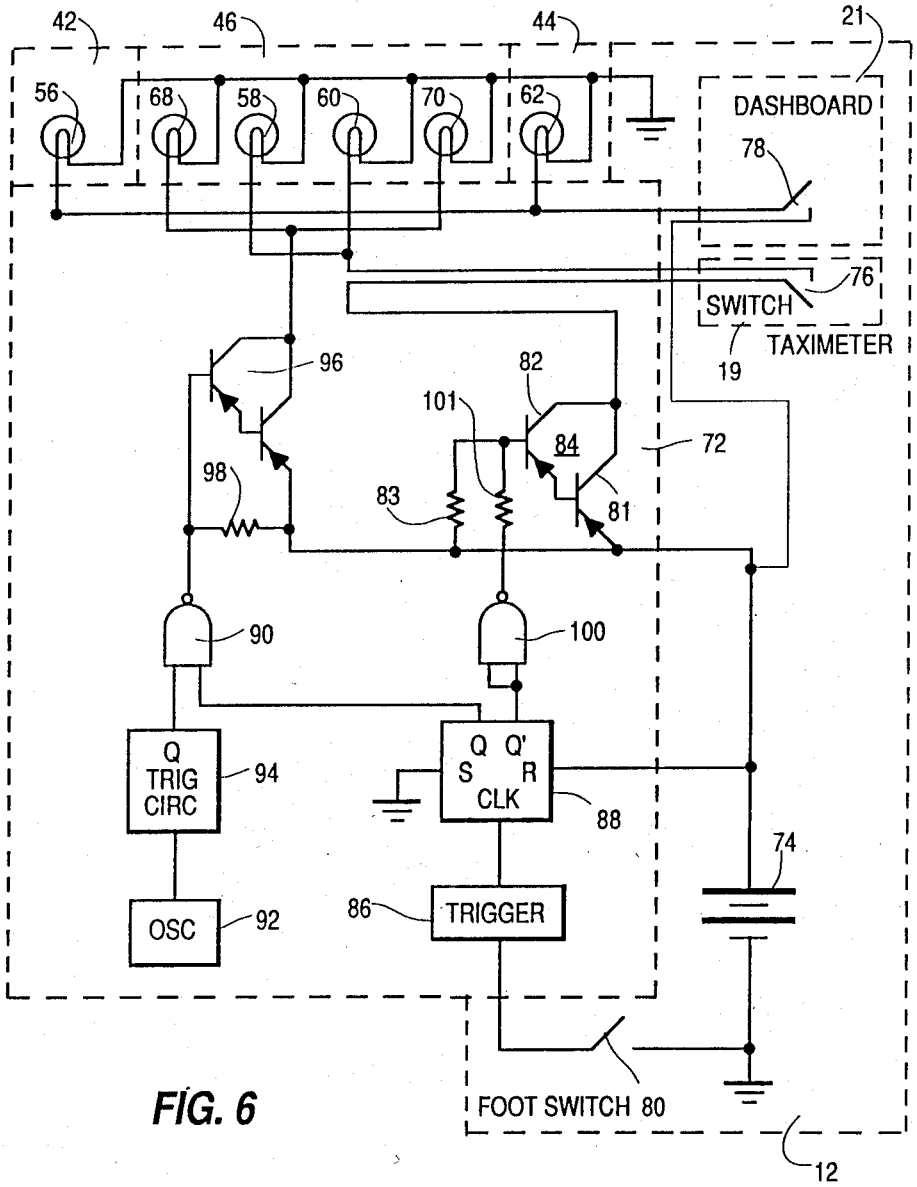
FIG. 6 is a schematic diagram of another electrical system of FIGS. 1 and 2 and embodying features of the invention.

According to a preferred embodiment of the invention the off-duty switch is connected directly between the lamps 56 and 62 and the battery 74 without passing through the Darlington circuit 84 as shown in FIG. 6. In that embodiment, the circuit 72 does not turn off the "off-duty" lights 56 and 62 during a distress signal. That is the "off-duty" lights remain off or on during flashing of the amber lights 68 and 70.

According to another embodiment of the invention, the system is used with an elongated roof light 104 carrying advertising 106 as shown in FIGS. 4 and 5. Here the roof light 104 includes identical front and rear displays 108 and 110 with lamps 56, 58, 60, 62, 68, and 70 in the front display duplicated by and connected in parallel with lamps 112, 114, 116, 118, 120, and 122 in the rear display. A single circuit 72 energizes the lamps in the front and the rear displays 108 and 110.

While embodiments of the invention have been described in detail, it will be evident to those skilled in the art that the invention may be embodied otherwise.

What is claimed is:

1. A distress indicating system for a vehicle having a notification light arrangement including a plurality of normally operating notification lamps, said system comprising:

switch means responsive to a driver's actuation for producing a hazard indication, circuit means responsive to said switch means for disabling the normally operating notification lamps, flashing means responsive to said switch means for producing a flash signal.

2. A system as in claim 1, wherein said circuit means includes a semiconductor circuit free of mechanical switches and said flashing means includes a semiconductor circuit free of mechanical switches.

3. A system as in claim 2, wherein said flashing means includes flash circuit and a plurality of distress lamps responsive to said flash circuit for blinking a distress signal.

4. A system as in claim 1, wherein said flashing means includes flash circuit and a plurality of distress lamps responsive to said flash circuit for blinking a distress signal.

5. An indicator system for a vehicle, comprising:

a translucent housing, a plurality of notification lamps and a plurality of distress lamps in said housing, connector means in said housing and connectable to a switch responsive to a driver's actuation for producing an electrical distress indication, circuit means in said housing and responsive to said switch means for disabling the notification lamps, flashing means in said housing and responsive to said switch means and connected to said distress lamps for causing said distress lamps to produce a visible flashing distress signal.

6. A system as in claim 5, wherein said circuit means includes a semiconductor circuit free of mechanical switches and said flashing means includes a semiconductor circuit free of mechanical switches.

7. A vehicle, comprising:

a body including a roof and an interior compartment for a driver, a translucent housing on said roof;

a plurality of notification lamps and a plurality of distress lamps in said housing, means in said compartment for operating said indicating lamps, a distress switch operable by a driver, connector means in said housing and connectable to said distress switch for producing an electrical distress indication, circuit means in said housing and responsive to said switch means for disabling the notification lamps, flashing means in said housing and responsive to said switch means and connected to said distress lamps for causing said distress lamps to produce a visible flashing distress signal.

8. A vehicle as in claim 7, wherein said circuit means includes a semiconductor circuit free of mechanical switches and said flashing means includes a semiconductor circuit free of mechanical switches.

* * * * *